US010370159B2

(12) United States Patent
Lannie et al.

(10) Patent No.: US 10,370,159 B2
(45) Date of Patent: Aug. 6, 2019

(54) APPARATUS, SYSTEM AND METHOD FOR FASTENING A CONTAINER AND A CLOSURE

(71) Applicant: PERI-DENT LTD, London (GB)

(72) Inventors: Michael Lannie, Northampton (GB); Jason Lucas, Northampton (GB); Tony Wye, Northampton (GB)

(73) Assignee: PERI-DENT LTD, London (GB)

( * ) Notice: Subject to any disclaimer, the term of this patent is extended or adjusted under 35 U.S.C. 154(b) by 150 days.

(21) Appl. No.: 15/351,408

(22) Filed: Nov. 14, 2016

(65) Prior Publication Data

US 2017/0144806 A1 May 25, 2017

(30) Foreign Application Priority Data

Nov. 23, 2015 (GB) ..... 1520646.9

(51) Int. Cl.
*B65B 7/28* (2006.01)
*B65D 25/22* (2006.01)
(Continued)

(52) U.S. Cl.
CPC ..... *B65D 43/22* (2013.01); *B65B 7/28* (2013.01); *B65D 25/22* (2013.01); *B65D 55/02* (2013.01);
(Continued)

(58) Field of Classification Search
CPC ..... B65D 43/22; B65D 55/02; B65D 25/22; B65D 5/4208; B65B 7/28
(Continued)

(56) References Cited

U.S. PATENT DOCUMENTS 3,132,742 A * 5/1964 Shapiro ..... B65D 31/04 206/278
4,106,801 A * 8/1978 De Lima Castro Neto ..... G09F 3/0311 292/307 R
(Continued)

FOREIGN PATENT DOCUMENTS

AU 2006202190 A1 6/2006
CA 2823329 A1 6/2010
(Continued)

OTHER PUBLICATIONS

"UK Search Report", GB Patent Application No. 1520646.9, dated Jan. 4, 20164 (5 pages).
(Continued)

*Primary Examiner* — James N Smalley
(74) *Attorney, Agent, or Firm* — Chad D Tillman; Tillman Wright, PLLC

(57) ABSTRACT

An apparatus and method for fastening a container and a closure in a closed configuration is disclosed. The apparatus includes an insertion portion configured for insertion through an aperture of the container and an aperture of the closure when the container and the closure are in the closed configuration; and a restraining portion configured to prevent passage of the restraining portion through the apertures. The insertion portion includes a hanging slot, and a mechanism configured to impede removal of the insertion portion from the apertures once the insertion portion has been inserted through the aperture such that the container and the closure are fastened between the mechanism and the restraining portion.

20 Claims, 2 Drawing Sheets

(51) Int. Cl.

| | |
|---|---|
| ***B65D 43/22*** | (2006.01) |
| ***B65D 55/02*** | (2006.01) |
| ***B65D 55/06*** | (2006.01) |
| ***B65D 75/56*** | (2006.01) |
| ***E05B 39/02*** | (2006.01) |

(52) U.S. Cl.
CPC ..... *B65D 55/06* (2013.01); *B65D 75/56* (2013.01); *E05B 39/02* (2013.01)

(58) Field of Classification Search
USPC .... 220/4.22, 4.23, 4.24, 315, 318, 833–835; 206/806, 1.5; 292/307 R
See application file for complete search history.

(56) References Cited

U.S. PATENT DOCUMENTS

| | | | | |
|---|---|---|---|---|
| 4,349,102 | A * | 9/1982 | Strongwater | B65D 25/22 206/45.24 |
| 4,356,919 | A | 11/1982 | Matney | |
| 4,632,242 | A * | 12/1986 | Choi | B65D 11/10 16/429 |
| 4,658,955 | A * | 4/1987 | Eichner | G11B 33/0411 206/1.5 |
| 4,682,688 | A * | 7/1987 | Budert | B25H 3/003 16/110.1 |
| 5,013,004 | A * | 5/1991 | Wilkins | B65B 61/14 206/806 |
| 5,037,000 | A * | 8/1991 | Selame | A47F 13/00 206/403 |
| 5,505,351 | A | 4/1996 | Najarian | |
| 5,672,238 | A | 9/1997 | Samuelson | |
| 6,196,389 | B1 | 3/2001 | Buetter et al. | |
| 6,401,921 | B1 | 6/2002 | Usami | |
| 6,905,024 | B1 | 6/2005 | Cao et al. | |
| 8,443,972 | B1 | 5/2013 | Pendergraph et al. | |
| 2003/0189047 | A1 | 10/2003 | McHutchinson | |
| 2004/0020810 | A1 | 2/2004 | Kao | |
| 2004/0020926 | A1 | 2/2004 | McHutchinson | |
| 2004/0195298 | A1 | 10/2004 | Schultz et al. | |
| 2006/0060481 | A1 | 3/2006 | Hartman et al. | |
| 2006/0201836 | A1 | 9/2006 | Pendergraph et al. | |
| 2006/0214083 | A1 | 9/2006 | Chang | |
| 2007/0241108 | A1 | 10/2007 | Rushe et al. | |
| 2008/0272017 | A1 | 11/2008 | Chang | |
| 2009/0236351 | A1* | 9/2009 | Chu | B65D 5/4208 220/751 |
| 2010/0127009 | A1* | 5/2010 | Trejo | B65D 25/22 220/751 |
| 2010/0140267 | A1 | 6/2010 | Sellari et al. | |
| 2011/0272550 | A1* | 11/2011 | Foltz | A47F 5/0006 248/309.1 |
| 2012/0067889 | A1 | 3/2012 | Lai | |
| 2012/0153109 | A1 | 6/2012 | Milbrandt et al. | |
| 2013/0277272 | A1 | 10/2013 | Oja et al. | |
| 2013/0308880 | A1 | 11/2013 | Jenkins | |
| 2013/0341382 | A1 | 12/2013 | Begim | |
| 2014/0042047 | A1 | 2/2014 | Pendergraph et al. | |
| 2014/0091004 | A1 | 4/2014 | Montgomery et al. | |
| 2014/0262930 | A1 | 9/2014 | Korinek | |
| 2015/0136632 | A1* | 5/2015 | Moir | B65D 25/22 206/470 |
| 2015/0136777 | A1 | 5/2015 | Baillies | |

FOREIGN PATENT DOCUMENTS

| | | | |
|---|---|---|---|
| CN | 202347962 | U | 7/2012 |
| CN | 202530900 | U | 11/2012 |
| DE | 19732753 | A1 | 2/1999 |
| DE | 202014104948 | U1 | 12/2014 |
| EP | 0751076 | A1 | 1/1997 |
| EP | 1419971 | A2 | 5/2004 |
| EP | 2502525 | A1 | 9/2012 |
| ES | 1070308 | U | 7/2009 |
| FR | 2948104 | A1 | 7/2016 |
| GB | 2480645 | A | 11/2011 |
| GB | 2523179 | A | 8/2015 |
| GB | 2523179 | A | 8/2017 |
| JP | H09118331 | A | 5/1997 |
| JP | 2002225844 | A | 8/2014 |
| WO | 2011043916 | A1 | 4/2011 |

OTHER PUBLICATIONS

"Extended European Search Report", EP Patent Application No. 16197605, dated Jan. 13, 2017 (10 pages).

* cited by examiner

APPARATUS, SYSTEM AND METHOD FOR FASTENING A CONTAINER AND A CLOSURE

CROSS-REFERENCE TO RELATED APPLICATION

The present application claims priority to United Kingdom patent application 1520646.9, filed Nov. 23, 2015, the disclosure of which is incorporated by reference herein in its entirety.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

FIELD

Embodiments of the present invention relate to apparatus, systems and methods for fastening a container and a closure. Some preferred embodiments, though without prejudice to the foregoing, relate to a fastening device for fastening a container and a closure to form retail packaging for one or more products.

BACKGROUND

Conventional retail packaging, not least for example packaging that is designed to be hung from rails in a retail environment, is not always optimal. Retail packaging may typically be required to securely contain one or more products so as to impede or indicate opening or interference of the retail package. For such retail packages, the act of opening the retail package may at least partially destroy or disfigure the retail package. Thus, the retail package, once opened, may be compromised and rendered unsuitable, suboptimal or visually unappealing for subsequent use in storing its product or products.

One or more preferred embodiments of the present invention may or may not address one or more of these issues.

SUMMARY

The present invention includes many aspects and features. Moreover, while many aspects and features relate to, and are described in, the context of retail packaging, the present invention is not limited to use only in retail packaging, as will become apparent from the following summaries and detailed descriptions of aspects, features, and one or more embodiments of the present invention.

According to various but not necessarily all embodiments of the invention, there is provided an apparatus configured to fasten a container and a closure for the same in a closed configuration, wherein the container and the closure each comprises an aperture, the apparatus comprising: an insertion portion configured for insertion through the apertures when the container and the closure are in the closed configuration; and, a restraining portion configured to prevent passage of the restraining portion through the apertures; wherein the insertion portion comprises a hanging slot, and a mechanism configured to impede removal of the insertion portion from the apertures once the insertion portion has been inserted through the apertures such that the container and the closure are fastened together between the mechanism and the restraining portion.

According to various but not necessarily all embodiments of the invention, there is provided a system comprising: the apparatus as above, the container, and the closure.

According to various but not necessarily all embodiments of the invention there is provided a method comprising: placing a container and a closure in a closed configuration; fastening the container and closure in the closed configuration by partially inserting the apparatus as mentioned above through an aperture of the container and an aperture of the closure.

According to various but not necessarily all embodiments of the invention there is provided an apparatus configured to fasten a container and a closure in a closed configuration, wherein the container and the closure each comprise an aperture, the apparatus comprising: insertion means configured for insertion through the apertures when the container and the closure are in the closed configuration; and restraining means configured to prevent passage of the restraining means through the apertures; wherein the insertion means comprises, hanging means configured to enable the apparatus to be hung, and impeding means configured to impede removal of the insertion portion from the apertures once the insertion means has been inserted through the apertures such that the container and the closure are fastened between the impeding means and the restraining means.

In addition to the aforementioned aspects and features of the present invention, it should be noted that the present invention further encompasses the various logical combinations and subcombinations of such aspects and features. Thus, for example, claims in this or a divisional or continuing patent application or applications may be separately directed to any aspect, feature, or embodiment disclosed herein, or combination thereof, without requiring any other aspect, feature, or embodiment.

BRIEF DESCRIPTION OF THE DRAWINGS

For a better understanding of various embodiments and scope of the invention, reference will now be made by way of example to the accompanying drawings in which preferred embodiments are represented. Furthermore, it should be appreciated that the figures are not necessarily to scale, and certain features and views of the figures may be shown schematically or exaggerated in scale in the interest of clarity and conciseness. For example, the dimensions of some elements in the figures may be exaggerated relative to other elements to aid explication.

DETAILED DESCRIPTION

Figure 1:
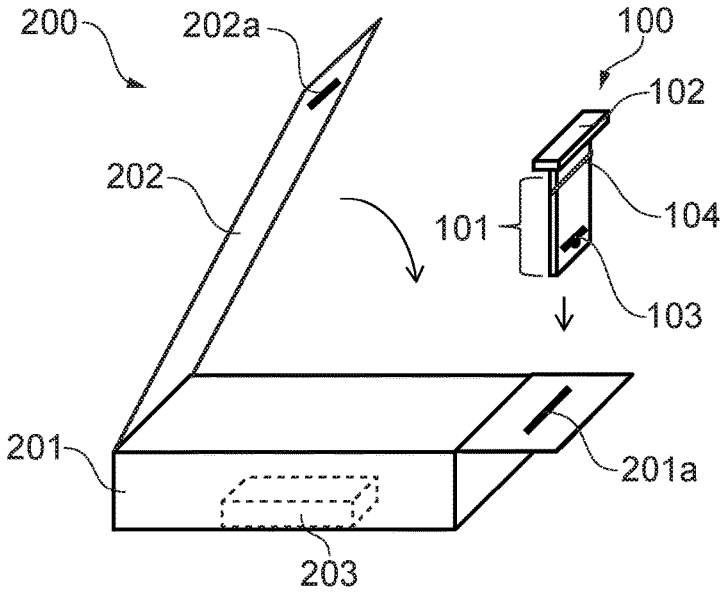
FIGS. 1 and 2 schematically illustrate an apparatus according to a preferred embodiment of the invention.

Embodiments of one or more apparatus, systems and methods for fastening a container and a closure for the same will now be described with reference to the Figures, wherein focus is placed on functional components necessary for describing the operation of the apparatus. Furthermore, similar reference numerals are used in the Figures to indicate similar features; however, for clarity, all reference numerals are not necessarily displayed in all figures.

Figure 2:
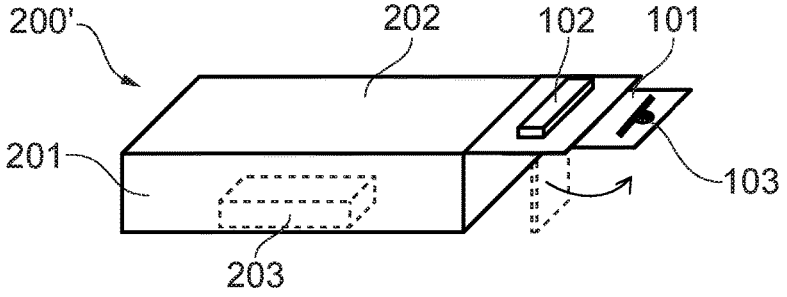

FIG. 1 schematically illustrates an apparatus 100 configured to fasten a container 201 and a closure 202 in a closed configuration (as shown in FIG. 2). The container 201 and the closure 202 each comprise an aperture 201*a*,202*a*. The apparatus 100 comprises an insertion portion 101 configured for insertion through the apertures 201*a*,202*a* when the container 201 and the closure 202 are in the closed configuration; and a restraining portion 102 configured to prevent passage of the restraining portion 102 through the apertures 201*a*,202*a*. The insertion portion 101 comprises a hanging slot 103, and a mechanism 104 configured to impede removal of the insertion portion 101 from the apertures 201*a*,202*a* once the insertion portion 101 has been inserted through the apertures 201*a*,202*a*, such that the container 201 and the closure 202 are fastened together between the mechanism 104 and the restraining portion 102.

The apparatus 100 may be a fastening device for fastening the container 201 and its closure 202 in the closed configuration, thereby providing securely closed packaging 200' for a product or products indicated generally at 203. Not only may the apparatus 100, in effect, act as a locking mechanism securing the container 201 and its closure 202 in a closed configuration, but also it comprises a hanging slot 103 thereby enabling the apparatus 100 (as well as the container 201 and closure 202 fixed thereto) to be hung, for example, in a retail environment. Thus, the apparatus 100 can be used, in combination with the container 201 and closure 202, to form a retail package 200'.

As used herein, the "container" may correspond to a housing, box, compartment or base portion for containing a product. The closure may be a lid or cover portion for closing or sealing the container in a closed configuration, thereby forming a closable container for the product or products.

The apertures 201*a*,202*a* may correspond to slots of holes in the container 201 and closure 202. The apertures 201*a*, 202*a* may be disposed on the container 201 and closure 202 such that they substantially overlie or overlap one another when the container 201 and closure 202 are in a closed configuration.

In various embodiments of the invention, the apparatus 100 is separate, distinct, and non-integral with each of the container 201 and the closure 202. The apparatus 100 and it constituent portions and parts may be formed as a single integral member.

The insertion portion 101 is configured (i.e., shaped and dimensioned) such that it may pass through each of the apertures 201*a*,202*a* of the container 201 and the closure 202. By contrast, the restraining portion 102 is configured (i.e., shaped and dimensioned) so as to prevent passage of the restraining portion 102 through the apertures 201*a*,202*a*. For example, with reference to FIG. 1, the dimensions of the insertion portion 101 (e.g., its width, thickness, or both) are configured to be less than the dimensions of the apertures 201*a*,202*a* (e.g., their width and thickness). By contrast, the dimensions of the restraining portion 102 (e.g., its width, thickness, or both) are configured to be greater than the dimensions of the apertures 201*a*,202*a*.

The insertion portion 101 may correspond to an insertion member or insertable tab of the apparatus 100 that is sized and dimensioned to pass through the apertures 201*a*,202*a* of the container 201 and the closure 202. In some embodiments, the insertion portion 101 may be dimensioned so as to closely correspond to the dimensions of the apertures 201*a*,202*a*, albeit of slightly lower dimensions, so as to ensure a tight fit of the insertion portion 101 to the apertures 201*a*,202*a*.

The restraining portion 102 may correspond to a retention tab having a flange, projecting rim, rib, or collar part having dimensions greater than the dimensions of the apertures 201*a*,202*a*.

The hanging slot 103 may correspond to a hanging hole, hang tab, or other suitable means to enable suspension therefrom, for example, so as to enable hanging from a hook, rail, or rack in a retail environment.

The mechanism 104 for impeding removal of the insertion portion 101 from the apertures 201*a*,202*a* may be configured to enable or facilitate insertion through the apertures 201*a*,202*a* in a direction of insertion but also be configured to prevent or impede removal of the inserted insertion portion 101 in an opposite direction. This may be achieved by, for example, a one-way insertion mechanism, non-return latches, detent, flexing barbs, and any other suitable means, including a biased or spring-loaded non-return mechanism.

Reference is now made to FIGS. 3 to 9 that illustrate use of an apparatus 100 in fastening a container 201 and a closure 202 in a closed configuration.

Figure 3:
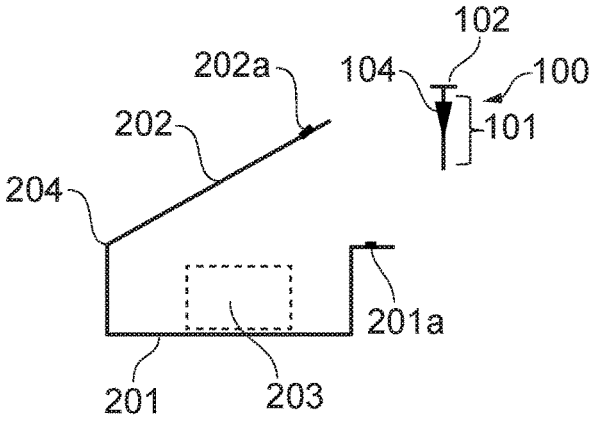
FIGS. 3 to 9 schematically illustrate use of an apparatus according a preferred embodiment of the invention.
Figure 4:
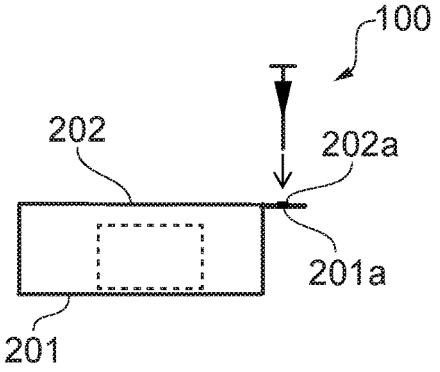

FIG. 3 shows the container 201 and closure 202 in an open configuration enabling a product or products 203 to be placed within the container 201, following which the container 201 and closure 202 can be brought into the closed configuration as shown in FIG. 4. In this embodiment, the container 201 and closure 202 are joined together via a hinge 204; however, it is to be appreciated that in other embodiments, other configurations of containers 201 and closures 202 can be used instead of having a hinged closure 202 and container 201. For example, the closure 202 could be slidably engaged with respect to the container 201 so as to enable them to slide with respect to one another into a closed configuration. In further embodiments, the closure 202 may screw onto the container 201 to achieve a closed configuration.

Figure 5:
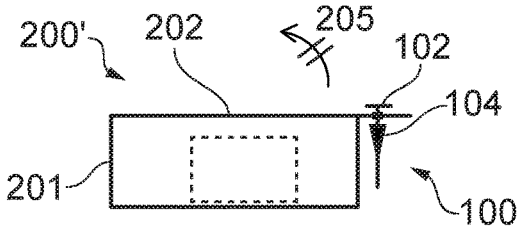

The container 201 and closure 202 each comprise an aperture 201*a* and 202*a*, which are configured and disposed such that, when in the closed configuration, the aperture 201*a* of the container and the aperture 202*a* of the closure are aligned with one another, i.e., such that the apertures 201*a*,202*a* are substantially co-located and overlap with one another (thereby enabling the insertion of the insertion portion 101 of the apparatus 100 through both of the apertures 201*a* and 202*a*, as shown in FIG. 5).

FIG. 5 shows the container 201 fastened by the apparatus 100 in the closed configuration being held in position between the impeding mechanism 104 (impeding removal of the insertion portion 101 from the apertures 201*a*,202*a*) and the restraining portion 102 (preventing passage of the restraining portion 102 through the apertures 201*a*,202*a*). This enables the container 201 and the closure 202 to be securely fastened in place between the mechanism 104 and the restraining portion 102, thereby preventing opening of the container 201 and closure 202 as symbolised by arrow 205. The configuration of FIG. 5 provides a packaging 200' for one or more products 203 that is particularly suitable for being stowed away or stored (e.g., for storage or transportation) so as to have a reduced size or form factor as compared to the configuration of FIG. 6.

Figure 6:
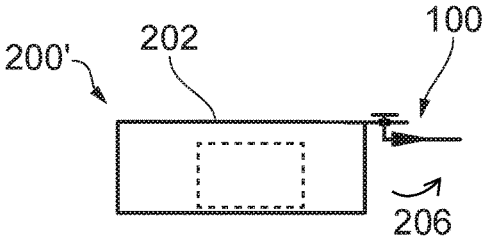

As illustrated in FIG. 6, the apparatus 100 is configured to be foldable (as indicated by arrow 206) so as to enable the insertion portion 101 and the hanging slot 103 formed therein to project outwards and away from the container enclosure such that the hanging slot 103 is exposed and available for use, i.e., to enable the package 200' to be hung by the hanging slot 103. Advantageously, this enables the apparatus 100 to be folded following insertion so as to facilitate the hanging in a retail environment (or folded away to be stowed when being stored or transported as shown in FIG. 5). In some embodiments, the impeding mechanism 104 comprises a folding/crease line that enables the apparatus 100 to fold in such a manner as to impede the removal of the insertion portion 101 from the apertures 201*a*,202*a*.

The apparatus 100 may further comprise a tamper indicating mechanism configured to indicate tampering of the apparatus 100 when in use, e.g., interference or attempted unfastening of the apparatus 100 from the container 201 and closure 202 due to attempted opening of the container 201 and closure 202. Such tamper indicating mechanism may comprise the apparatus 100 being frangible, tearable, breakable, shatterable, or friable. The apparatus 100 may be configured such that, once inserted into the apertures 201*a*, 202*a*, it is not possible to remove the apparatus 100 without breaking the apparatus 100, thereby providing an indication that the apparatus 100 has been tampered with.

Figure 7:
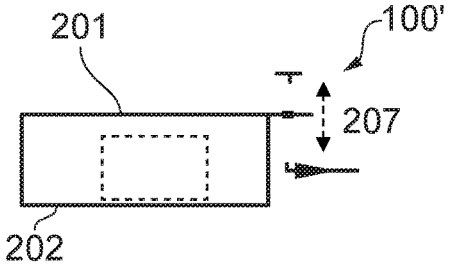
Figure 8:
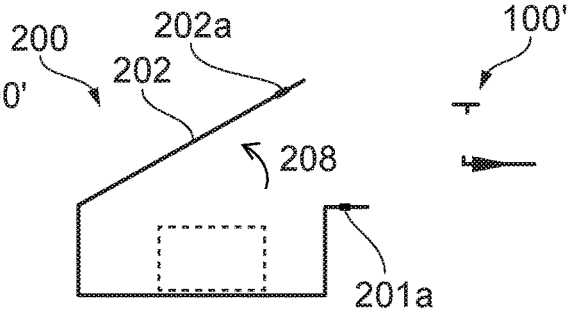

FIG. 7 illustrates the apparatus 100' having been broken (as indicated by double headed arrow 207) along a frangible or weakened section of the apparatus 100' between the restraining portion 102 and the impeding mechanism 104, thereby separating the insertion portion 101 and the restraining portion 102 and, thus, unfastening the container 201 and the closure 202 so as to enable the closure 201 and container 202 to be opened (as represented by arrow 208) to an open configuration as shown in FIG. 8.

A frangible region of the apparatus 100' may be configured so as to break upon unfastening of the apparatus 100' from the container 201 and closure 202 such that the apparatus 100' cannot be removed from the container 201 and the closure 202 without damaging either the container 201, the closure 202, or both.

Embodiments of the apparatus 100 may provide an indication as to tampering of the package 200' (such as opening or/attempted opening or prying open of the container 201 and the closure 202 from the fastened closed configuration) but without actually damaging the container 201 and the closure 202 itself. Since the container 201 and closure 202 preferably are not affected by the breaking of the apparatus 100 upon opening of the container 201 and closure 202, the container 201 and closure 202 themselves are not functionally nor aesthetically compromised during the opening process and, thus, can be continued to be used for containing the one or more products 203.

Advantageously, embodiments of the invention may enable the container 201 and closure 202 to serve as a secure tamperproof or tamper-indicating retail packaging 200' when used in combination with the apparatus 100, and then, after breaking the apparatus 100 to open the package, the container 201 and closure 202 can be continued to be used as a non-secure packaging or closable container 200.

Figure 9:
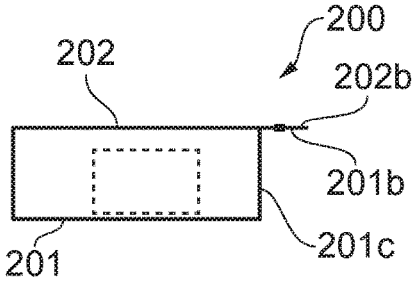

Advantageously, this avoids the need for specific retail packaging for containing a separate and distinct product package itself containing the one or more products. Instead, in embodiments of the invention, the container 201 and closure 202 may be able to provide dual purpose retail packaging 200' (i.e., with secured/tamper indicating packaging) and, thereafter, product packaging or closable container 200 (i.e., a reusably openable container 201 and closure 202). In such embodiments, the container 201 and closure 202 may be configured so as to mate or engage with one another so as to releasably retain the container 201 and the closure 202 in the closed configuration, as shown in FIG. 9. Any such suitable releasably retaining mechanism may be used in this, not least for example a snap fit mechanism that enables the container 201 and the closure 202 to be retained in a closed configuration without use of the apparatus 100, albeit in a non-secure and non-tamper indicative manner.

With such embodiments, after the apparatus 100 has served its purpose of securing the container 201 and the closure 202 in a secure tamper indicating package, i.e., so as to act as a retail packaging 200' in a retail environment, thereafter, the container 201 and closure 202 can continue to be used as a packaging or closable container 200 for the product 203, for example in a normal use or domestic environment.

In the containers 201 and closures 202 shown in the figures, the aperture 201*a* of the container 201 is located on a flange portion 201*b* of the container 201. Likewise, the aperture 202*a* of the closure 202 is located on a flange portion 202*b* of the closure 202. Such flange portions 201*b*,202*b* are portions of the container 201 and the closure 202 that overlap with one another in a closed configuration. The apertures 201*a*,202*a* are located on the respective flange portions 201*b*,202*b* in positions such that the apertures 201*a*,202*b* substantially align with one another. However, it is to be appreciated that other configurations and positions of the apertures 201*a*,202*a* are possible. For example, instead of having the aperture 201*a* on projecting flange portion 201*b*, the aperture 201*a* of the container 201 may instead be located in a side end wall 201*c* of the container 201. In this case the closure 202 may be provided with a corresponding overlapping side end wall (not shown) which overlaps the side end wall 201*c* of the container 201, and the aperture 202*a* of the closure 202 may be located within such an overlapping side wall of the closure 201.

Figure 10:
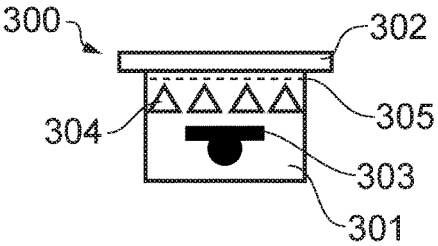
FIG. 10 shows a first elevational view.
Figure 11:
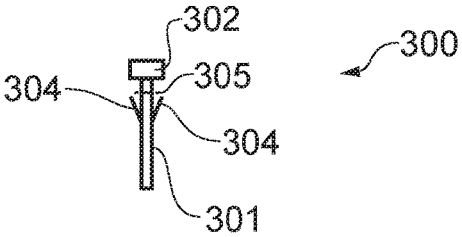
FIG. 11 shows a second elevational view in a direction of view generally orthogonal to that of FIG. 10, of another apparatus according to a further embodiment of the invention.

FIG. 10 shows a first elevational view, and FIG. 11 shows a second elevational view in a direction of view generally orthogonal to that of FIG. 10, of an apparatus 300 according to a further embodiment of the invention. The apparatus 300 comprises an insertion portion 301, restraining portion 302, and hanging slot 303 similar to that of embodiments described above. An impeding mechanism 304 takes the form of flexible barbs that flexibly protrude outwards so as to provide a one-way insertion mechanism of the insertion portion 301 through the apertures 201*a*,202*a* of the container 201 and closure 202. A frangible portion 305 also is provided, for example in the form of a weakened section of the apparatus 300, which is readily breakable without damaging the container 201 and the closure 202, thereby providing tamper indication that may not damage or adversely affect either the container 201 and closure 202. The hanging slot 303 is shown as a euro hook; however, the hanging slot 303 may alternatively comprise any suitable aperture or slot suitable for enabling the apparatus 300 to be hung, for example, on a rail or display rack in a retail environment.

Aspects of the present invention also extend to a method for fastening the container 201. The method comprises: placing the container 201 and closure 202 in a closed configuration and fastening the container 201 and closure 202 in the closed configuration; and partially inserting the apparatus 100 through the aperture 201*a* of the container 201 and the aperture 202*a* of the closure 202.

Advantageously, various embodiments of the present invention may provide an apparatus 100 for fastening a container 201 and closure 202 so as to securely retain the container and closure in a closed configuration. Advantageously, due to the impeding mechanism 104 and the restraining portion 102, the mere act of partial insertion of the apparatus 100 may ensure the automated fastening of the container 201 and closure 202 thereby providing a simple way in which to fasten the container and closure that may not require multiple parts or assembly or the use of adhesive (e.g., the application of tamper-indicating stickers or labels). Thus, the apparatus 100 may be easily attached to the container 201 and closure 202 providing easy installation. Not only may the attachment to the container 201 and closure 202 avoid damaging or deforming the container 201 and closure 202, but moreover the removal of the apparatus 100, by breaking the apparatus 100, likewise may not damage or deform the container 201 or closure 202, thus, not affecting the functionality or appearance of the same, such that they can continue to be used as an aesthetically pleasing package for the product 203 outside of the retail environment.

Embodiments of the invention may avoid the need for separate retail packaging and product packaging as the apparatus 100 effectively provides the requirements for retail packaging (tamper-indicating and hanging-slot features, which can be removed when no longer required for a retail environment) leaving just the container 201 and closure 202 to act as a package for the one or more products 203.

The apparatus may be configured such that is may be easily removed by a consumer or user. For example, the apparatus may comprise a frangible region (not least, for example, a tear off strip) to enable the apparatus to be easily removed by the consumer so as to leave the container 201 and closure 202 to act as a conventional package for the one or more products.

The embodiments of the present invention and the accompanying claims may be suitably combined in any manner apparent to one of ordinary skill in the art.

Features described in the preceding description may be used in combinations other than the combinations explicitly described herein. Although functions have been described with reference to certain structures, those functions may be performable by other structures whether described or not. Although features have been described with reference to certain embodiments, those features may also be present in other embodiments whether described or not. Although various embodiments of the present invention have been described in the preceding paragraphs, it should be appreciated that modifications to the embodiments described can be made without departing from the scope of the invention, which scope is defined by claim.

With regard solely to construction of any claim with respect to the United States, no claim element is to be interpreted under 35 U.S.C. 112(f) unless the explicit phrase "means for" or "step for" is actually used in such claim element, whereupon this statutory provision is intended to and should apply in the interpretation of such claim element. With regard to any method claim including a condition precedent step, such method requires the condition precedent to be met and the step to be performed at least once during performance of the claimed method.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, or denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." When used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

The term "comprise" is used in this document with an inclusive not an exclusive meaning. That is any reference to X comprising Y indicates that X may comprise only one Y or may comprise more than one Y. If it is intended to use "comprise" with an exclusive meaning then it will be made clear in the context by referring to "comprising only one . . . " or by using "consisting".

In this description, reference has been made to various embodiments. The description of features or functions in relation to an embodiment indicates that those features or functions are present in that embodiment. The use of the term "example" or "for example" or "may" in the text denotes, whether explicitly stated or not, that such features or functions are present in at least the described example, whether described as an example or not, and that they can be, but are not necessarily, present in some or all other embodiments. Thus "example", "for example" or "may" refers to a particular instance in a class of embodiments. A property of the instance can be a property of only that instance or a property of the class or a property of a sub-class of the class that includes some but not all of the instances in the class.

The above description describes some embodiments of the present invention; however, those of ordinary skill in the art will be aware of possible alternative structures and method features which offer equivalent functionality to the specific embodiments of such structures and features described herein above and which for the sake of brevity and clarity have been omitted from the above description. Nonetheless, the above description should be read as implicitly including reference to such alternative structures and method features which provide equivalent functionality unless such alternative structures or method features are explicitly excluded in the above description of the embodiments of the present invention.

While endeavouring in the foregoing specification to draw attention to those features of embodiments of the present invention believed to be of particular importance, it should be understood that the applicant claims protection in respect of any patentable feature or combination of features hereinbefore referred to or shown in the drawings whether or not particular emphasis has been placed thereon.

What is claimed is:

1. An apparatus configured to fasten a container and a closure in a closed configuration, wherein the container and the closure each comprise an aperture, the apparatus comprising:

(a) an insertion portion configured for insertion through the apertures when the container and the closure are in the closed configuration;

(b) a restraining portion configured to prevent passage of the restraining portion through the apertures; and (c) a tamper indicating mechanism configured to indicate tampering upon unfastening of the apparatus from the container and closure;

(d) wherein the insertion portion comprises:

(i) a hanging slot, and (ii) a mechanism configured to impede removal of the insertion portion from the apertures once the insertion portion has been inserted through the apertures such that the container and the closure are fastened between the mechanism and the restraining portion, wherein the mechanism is located between the restraining portion and the hanging slot.

2. The apparatus of claim 1, wherein the apparatus is foldable.

3. The apparatus of claim 2, wherein the apparatus is configurable into a folded position, wherein the folded position is configured to impede removal of the insertion portion from the apertures following insertion of the insertion portion into the apertures.

4. The apparatus of claim 1, wherein the insertion portion is configured to enable insertion through the apertures in a direction of insertion, and is configured to prevent removal of the inserted insertion portion in an opposite direction.

5. The apparatus of claim 1, wherein the hanging slot is integrally formed with the apparatus.

6. The apparatus of claim 1, wherein the hanging slot comprises one or more of an aperture for enabling the apparatus to be hung on a rack, and a euro hook.

7. The apparatus of claim 1, wherein the apparatus is a fastening device for fastening the container and the closure in the closed configuration.

8. Packaging, comprising:

(I) a container having an aperture;

(II) a closure having an aperture; and (III) an apparatus configured to fasten the container and the closure in a closed configuration, the apparatus comprising:

(a) an insertion portion configured for insertion through the apertures when the container and the closure are in the closed configuration;

(b) a restraining portion configured to prevent passage of the restraining portion through the apertures; and (c) a tamper indicating mechanism configured to indicate tampering upon unfastening of the apparatus from the container and closure;

(d) wherein the insertion portion comprises:

(i) a hanging slot, and (ii) a mechanism configured to impede removal of the insertion portion from the apertures once the insertion portion has been inserted through the apertures such that the container and the closure are fastened between the mechanism and the restraining portion, wherein the mechanism is located between the restraining portion and the hanging slot.

9. The packaging of claim 8, wherein the apertures are configured such that, when the container and the closure are in the closed configuration, the apertures are aligned.

10. The packaging of claim 8, wherein the container comprises a flange portion and wherein the aperture of the container is located in the flange portion.

11. The packaging of claim 8, wherein the closure and the container are joined together.

12. The packaging of claim 8, wherein the container and the closure are separate components.

13. The packaging of claim 8, wherein the container and the closure are configured to inter-engage with one another so as to releasably retain the container and the closure in the closed configuration.

14. The packaging of claim 8, wherein the closure comprises a lid.

15. The packaging of claim 8, wherein the container and the closure are joined together via a hinge.

16. The packaging of claim 8, wherein the closure slides relative to the container in transitioning into the closed configuration.

17. The packaging of claim 8, wherein the closure screws onto the container in transitioning into the closed configuration.

18. The packaging of claim 8, wherein the container and the closure are retained in a closed configuration via a snap fit mechanism.

19. The packaging of claim 8, wherein the mechanism configured to impede removal of the insertion portion comprises flexible barbs that flexibly protrude outwardly so as to provide for one-way insertion of the insertion portion through the apertures.

20. A method comprising:

(I) placing a container and a closure in a closed configuration; and (II) fastening the container and closure in the closed configuration by partially inserting an apparatus through an aperture of the container and an aperture of the closure;

(III) wherein the apparatus comprises, (a) an insertion portion configured for insertion through the apertures when the container and the closure are in the closed configuration, (b) a restraining portion configured to prevent passage of the restraining portion through the apertures, and (c) a tamper indicating mechanism configured to indicate tampering upon unfastening of the apparatus from the container and closure, (d) wherein the insertion portion comprises, (i) a hanging slot, and (ii) a mechanism configured to impede removal of the insertion portion from the apertures once the insertion portion has been inserted through the apertures such that the container and the closure are fastened between the mechanism and the restraining portion, wherein the mechanism is located between the restraining portion and the hanging slot.

* * * * *